US007287382B2

(12) United States Patent
Henriquez

(10) Patent No.: US 7,287,382 B2
(45) Date of Patent: Oct. 30, 2007

(54) GAS TURBINE COMBUSTOR END COVER

(76) Inventor: John Henriquez, 8775 SE. Bahama Circle, Hobe Sound, FL (US) 33455

( * ) Notice: Subject to any disclaimer, the term of this patent is extended or adjusted under 35 U.S.C. 154(b) by 610 days.

(21) Appl. No.: 10/710,525

(22) Filed: Jul. 19, 2004

(65) Prior Publication Data

US 2006/0010873 A1 Jan. 19, 2006

(51) Int. Cl.
*F02C 7/22* (2006.01)

(52) U.S. Cl. ..... 60/739; 60/746; 431/181

(58) Field of Classification Search ..... 60/39.463, 60/739, 746, 752; 137/561.4; 431/181, 431/187

See application file for complete search history.

(56) References Cited

U.S. PATENT DOCUMENTS

| | | | | |
|---|---|---|---|---|
| 4,930,703 | A | 6/1990 | Ford et al. | 239/417 |
| 5,263,849 | A * | 11/1993 | Irwin et al. | 431/181 |
| 6,112,971 | A | 9/2000 | Castaldo et al. | 228/126 |
| 6,802,178 | B2 * | 10/2004 | Sprouse et al. | 60/39.463 |
| 6,883,329 | B1 * | 4/2005 | Martling | 60/746 |

* cited by examiner

*Primary Examiner*—L. J. Casaregola

(57) ABSTRACT

An end cover for a gas turbine combustor that eliminates the use of braze joints within the plate portion of the end cover is disclosed. The end cover comprises a plate and a plurality of fluid inlets with the fluid inlets directing fluids to first and second manifolds machined into the end cover. The fluids within the end cover are kept separate proximate each of the plurality of first openings by a wall that is integrally formed from a portion of the end cover plate.

19 Claims, 4 Drawing Sheets

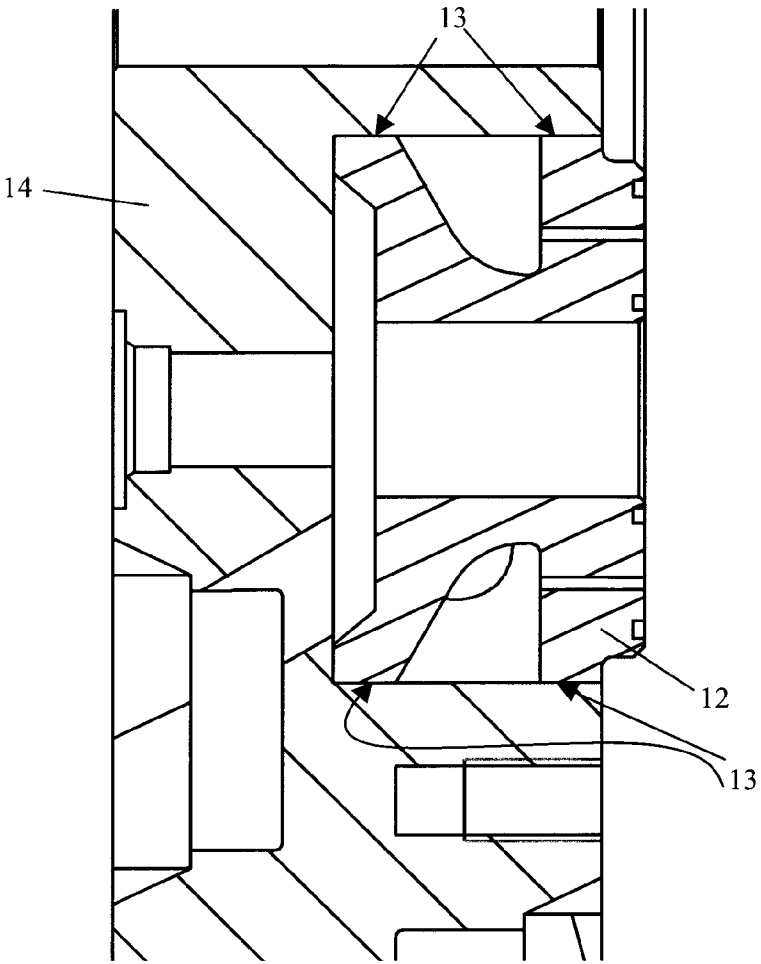
Figure 1B – Prior Art
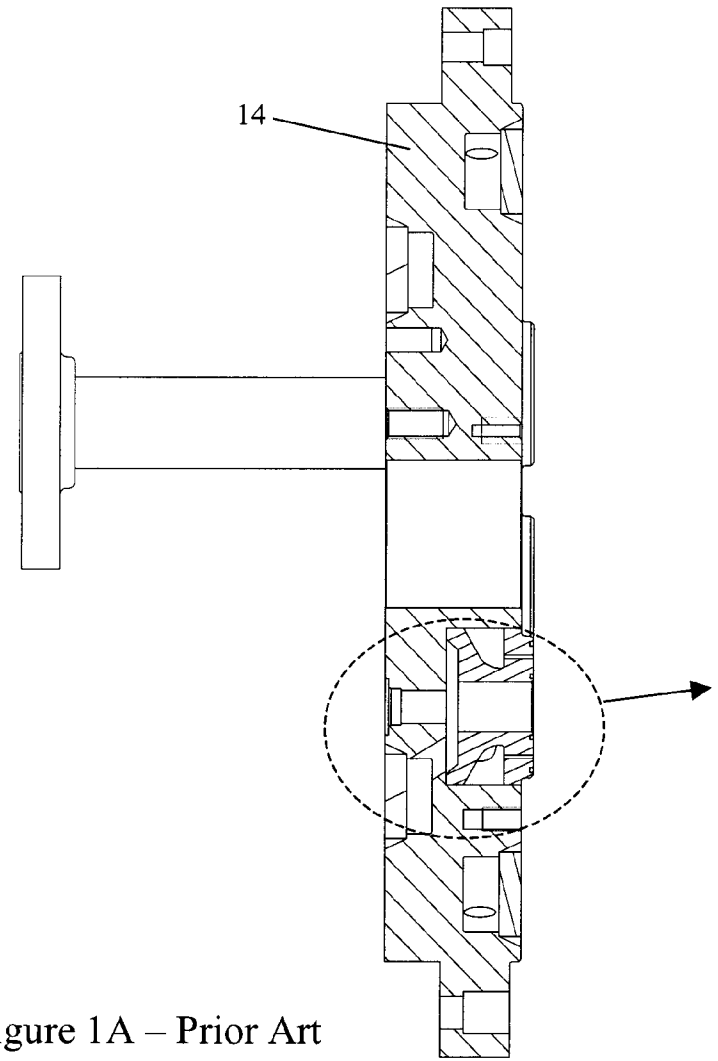
Figure 1A – Prior Art

GAS TURBINE COMBUSTOR END COVER

BACKGROUND OF INVENTION

The present invention relates to gas turbine combustors and more specifically to the end cover that directs the fuel to the fuel injectors of a combustor.

A gas turbine engine typically comprises a compressor, at least one combustor, and a turbine. The pressure of air passing through the compressor is raised through each stage of the compressor and is then directed towards the combustion system. Gas turbine combustion systems typically comprise multiple components to properly and efficiently mix fuel with the compressed air in order to ignite this mixture to create hot combustion gases. The hot combustion gases are then directed towards a turbine, which produces work, typically for thrust, or shaft power if the engine shaft is connected to an electrical generator.

A typical combustion system includes a combustion liner where ignition occurs of the fuel and air mixture. Due to the operating pressures of the combustion system, the combustion liner is usually contained within a case or pressure vessel. Fixed to this case is an end cover that typically directs the flow of fuel from a fuel source to the fuel injectors for injection into the combustion liner. Depending on the type of performance and emissions desired from the combustor, the combustion system can burn both liquid and gaseous fuels. As a result, the end cover must be capable of handling different fuel types, large temperature gradients and pressure forces, such that no mixing of fuel types occurs within the end cover.

Temperatures of the end cover can range typically range between 250 and 700 degrees F. with pressures upwards of 250 $lb/in^2$.

A known method of providing a combustor end cover meeting the goal of delivering multiple fuel types separately involves utilizing braze joints within the end cover.

A prior art example of this type of end cover configuration is disclosed in U.S. Pat. No. 6,112,971, which discloses an improved vacuum brazing process to avoid joint failures. In a typical brazing process, two components that are to be joined together are first machined having very tight tolerances. For example, referring to FIGS. 1A and 1B, insert 12, which is brazed to end cover 14, has a diametrical gap 13 between insert 12 and end cover 14 of 0.001-0.005 inches. Braze paste or foil, which is of an acceptable material for bonding the two components, is then taped or injected by syringe into gap 13. The end cover is then placed in a furnace and heated and cooled according to a predetermined cycle, such that the insert bonds to the end cover to produce a joint capable of handling the temperature gradients and pressures applied to the end cover.

While brazing can provide the desired joint between mating components, the process does have its drawbacks, especially with respect to its application on a combustion end cover. Depending on the configuration, often times the resulting joint cannot be inspected visually, which is the preferred inspection technique. As a result, more costly and time-consuming inspection procedures are required, such as pressure testing, x-ray, and ultrasonic inspection. Furthermore, the brazing process requires, as previously specified, tight tolerance gaps between components to be joined together, which are more costly to manufacture. What is needed is a simpler more cost effective end cover configuration that can flow multiple fluids separately without requiring the brazing processes well known in the prior art.

SUMMARY OF INVENTION

The present invention provides an end cover for a gas turbine combustor that is capable of directing multiple fluids through separate manifolds to a plurality of openings for feeding a plurality of fuel injectors, such that the fluids do not interact or mix within the end cover. This is accomplished by providing a wall that is integrally formed within the plate portion of the end cover. Manufacturing an end cover with this integral wall removes the time consuming and costly steps involved in brazing inserts within the injector openings. Furthermore, additional savings are gained by the elimination of braze joint inspections and testing.

The end cover comprises a plate having a diameter, thickness, forward face, aft face, and a centerline. A first fluid inlet and second fluid inlet each extend from the aft face with a first manifold in fluid communication with the first fluid inlet and a second manifold in fluid communication with the second fluid inlet. A plurality of first openings are located along the end cover forward face and about the centerline, with the first openings in fluid communication with the first and second manifolds such that the fluids from the respective manifolds are separated by a wall integrally formed from a portion of the end cover plate. In the preferred embodiment the first and second fluid inlets and manifolds contain air and gas respectively. The end cover further comprises a plurality of second openings that are located in the end cover aft face and correspond to each of the first openings for supplying a liquid fuel to the first openings. A plurality of fuel injectors can be fixed to the end cover proximate the first openings for injecting the fuels and air into a combustion chamber.

It is an object of the present invention to provide an end cover for a gas turbine combustor that eliminates the braze joints, which serve to separate fluids within the end cover.

BRIEF DESCRIPTION OF DRAWINGS

FIG. 1A is a cross section view of a prior art end cover.

FIG. 1B is a detailed cross section view of a portion of a prior art end cover.

DETAILED DESCRIPTION

Figure 2:
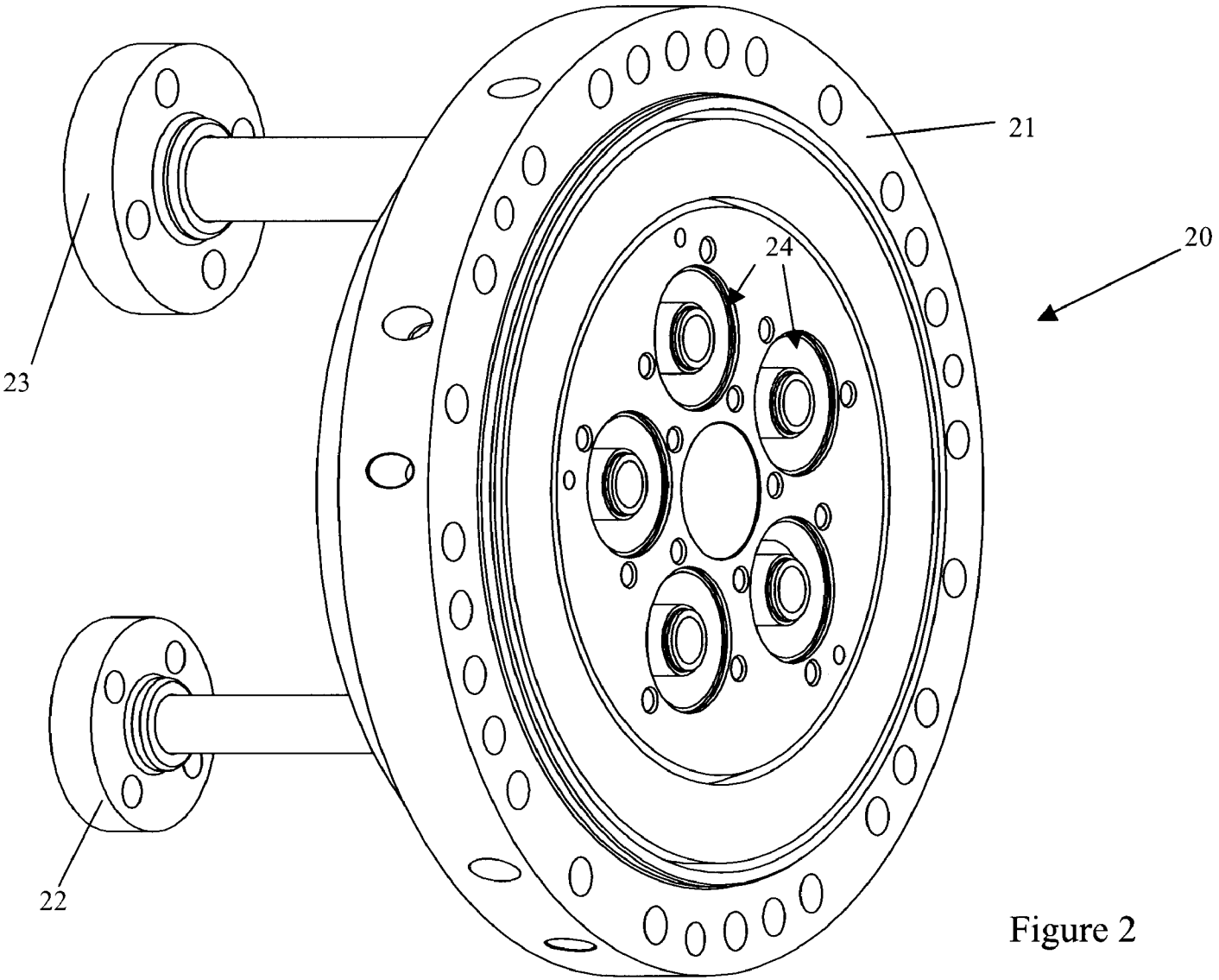
FIG. 2 is a perspective view of an end cover in accordance with the present invention.
Figure 3B:
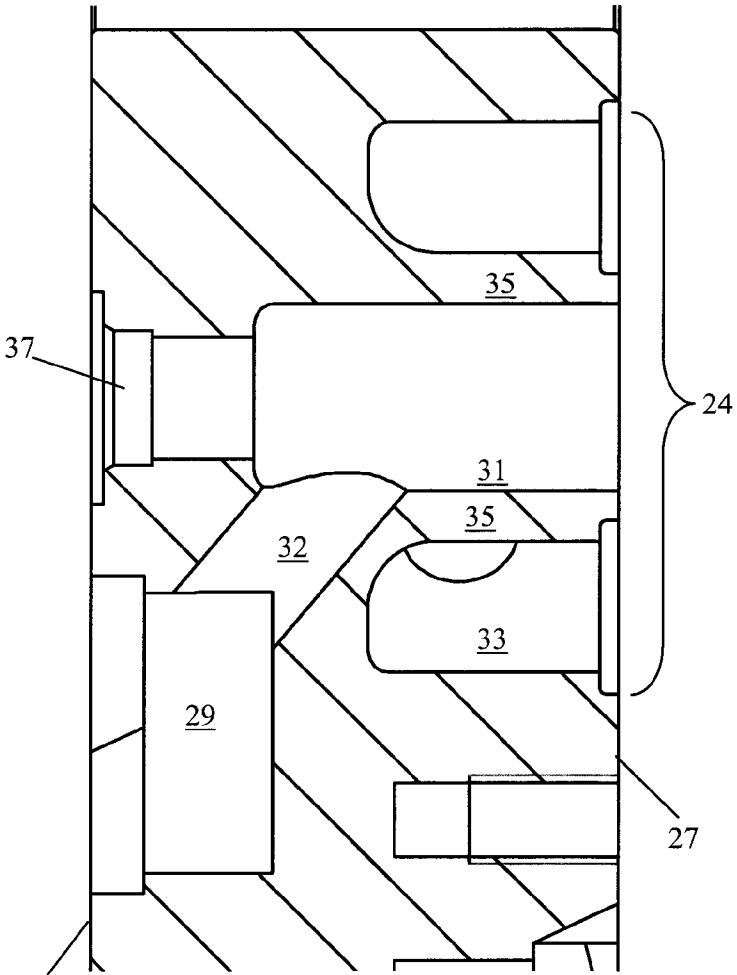
FIG. 3B is a detailed cross section view of a portion of an end cover in accordance with the present invention.
Figure 3A:
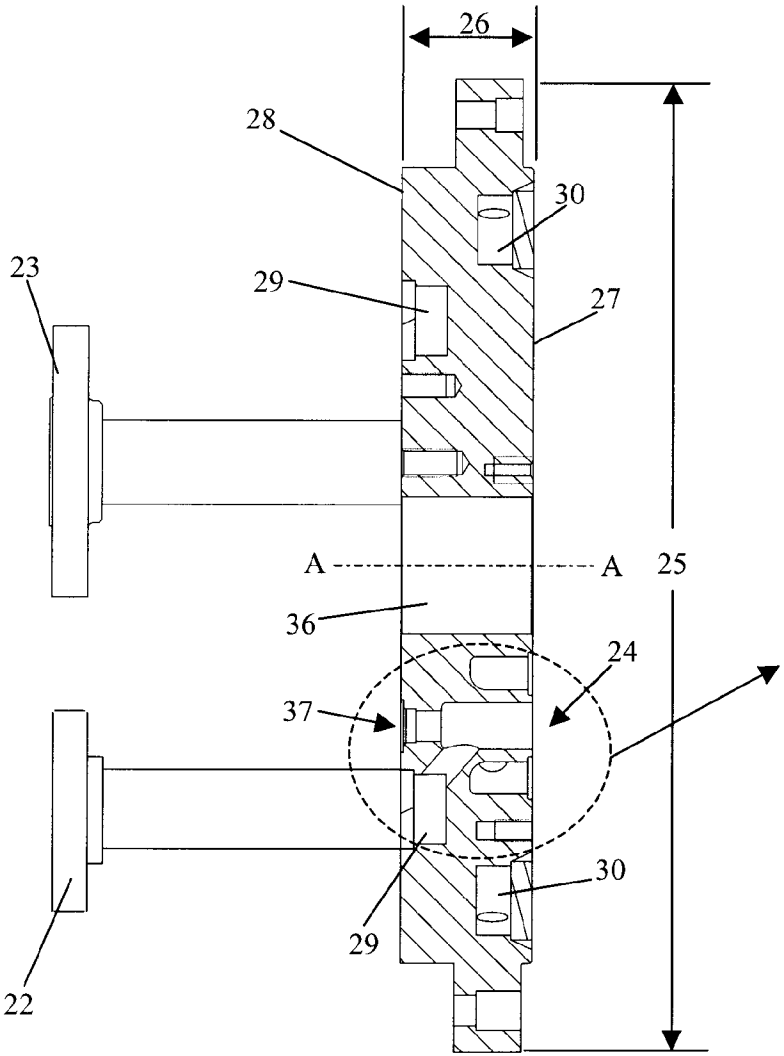
FIG. 3A is a cross section view of an end cover in accordance with the present invention.

The present invention will now be described in detail with specific reference to FIGS. 2-4B. Referring now to FIG. 2, end cover 20 for a gas turbine combustor in accordance with the preferred embodiment of the present invention is shown in perspective view. End cover 20 comprises a plate 21, a first fluid inlet 22, a second fluid inlet 23, and a plurality of first openings 24. Referring now to FIGS. 3A and 3B, plate 21 has a plate diameter 25, plate thickness 26, forward face 27, aft face 28, and a centerline A-A. First fluid inlet 22 and second fluid inlet 23 each extend from aft face 28 as shown in FIG. 3A. First fluid inlet 22 is in fluid communication with a first manifold 29 while second fluid inlet 23 is in fluid communication with a second manifold 30. In the preferred embodiment of the present invention, second manifold 30 is located radially outward of first manifold 29.

Figure 4B:
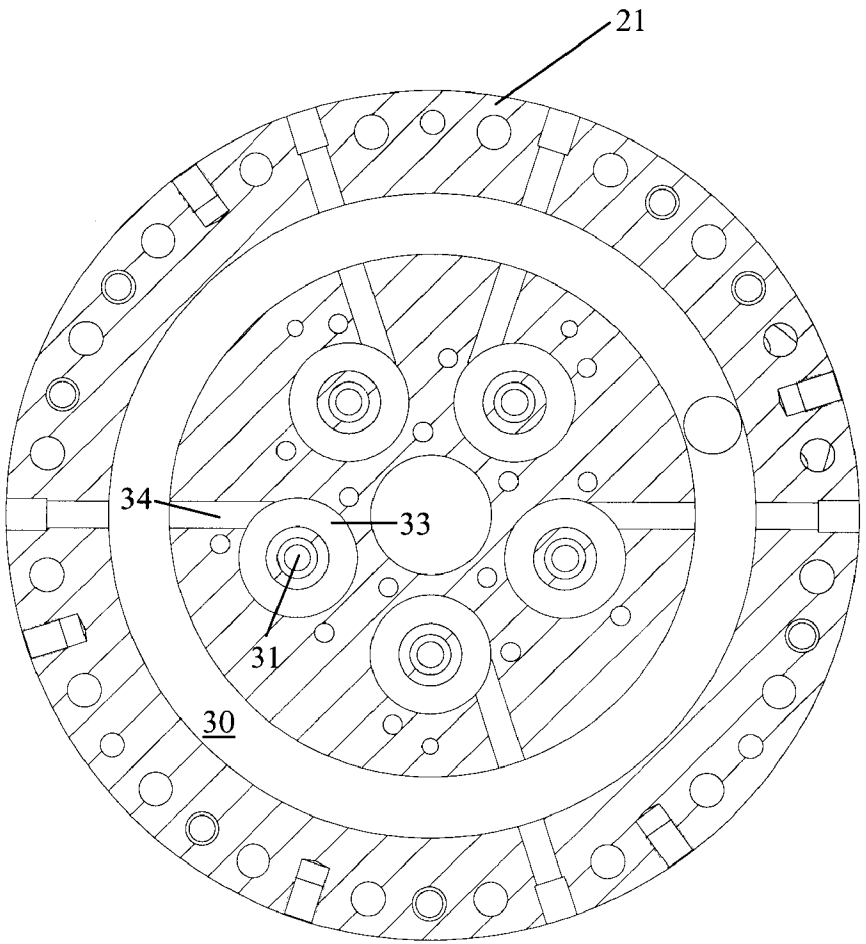
FIG. 4B is a section taken through the second manifold of an end cover in accordance with the present invention.
Figure 4A:
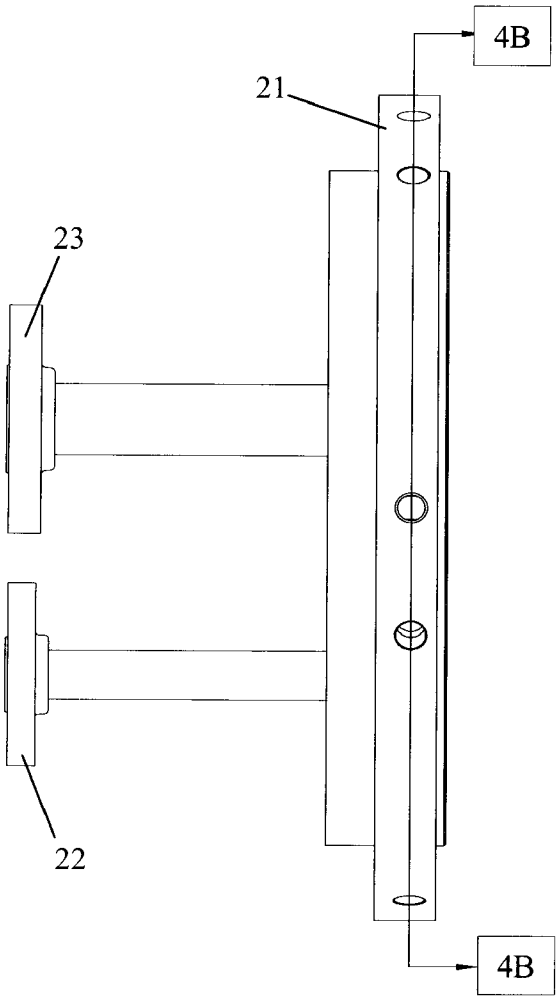
FIG. 4A is an elevation view of an end cover in accordance with the present invention.

Plurality of first openings 24, which preferably comprises at least five openings, are in fluid communication with first manifold 29 and second manifold 30 and are located in a generally annular array about centerline A-A along forward face 27. For each of first openings 24, a first fluid, preferably air, from first manifold 29 passes to a first passage 31 through a plurality of first feed holes 32 as shown in FIG. 3B. A second fluid, preferably gas, from second manifold 30 passes to a second passage 33 as shown in FIG. 4B. For second manifold 30, passing the fluid to second passage 33 is accomplished by a plurality of feed holes 34 that connect second manifold 30 to second passage 33. This is shown in FIG. 4B, which is a cross section cut through plate 21 of FIG. 4A. Passages 31 and 33 are separated by wall 35, which is integrally formed from a portion of plate 21. The exact dimensions of wall 35 depends on various factors including pressures and temperatures of the fluids in passages 31 and 33 as well as the pressures and temperatures applied to forward face 27 by the combustor. Wall 35 must have a sufficient thickness in order to not buckle under these loads. The air and gas from passages 31 and 33, respectively, will then pass into a fuel injector (not shown) for injection into the combustor. The fuel injector has been removed for clarity purposes since the features of the injector such as injector hole location, size, swirler size, location, swirl angle, etc. are independent of the features of the present invention. However, it is to be understood that plurality of first openings 24 contain a means for fixing a fuel injector to end cover 20, proximate forward face 27. The preferred means for fixing a fuel injector to end cover 20 comprises a threaded region that corresponds to a threaded region on the fuel injector. Use of interlocking threads allows for easier removal of a fuel injector for service or replacement than alternate means such as welding.

Referring back to FIG. 3A, end cover 20 further comprises a central opening 36 located along centerline A-A and extending from aft face 28 to forward face 27. Typically this opening is used to mount a pilot fuel nozzle to end cover 20 that is used to provide a stable flame source to the combustor.

Referring back to FIGS. 3A and 3B, in addition to plurality of first openings 24 and central opening 36, end cover 20 also preferably includes a plurality of second openings 37 located in aft face 28 and corresponding to each of plurality of first openings 24. Plurality of second openings provide a means to introduce a liquid fuel to first openings 24 for use with a dual fuel injector.

The present invention end cover, which is preferably fabricated from stainless steel, has a plate 21 that is entirely machined. The prior art end cover had a majority of its features machined, including a section of material that is removed in which insert 12 (see FIG. 1B) is inserted and brazed into end cover 14. As previously discussed brazing components of a combustor end cover together has some disadvantages with respect to cost, manufacturing tolerance requirements, and the ability to thoroughly inspect the resulting joint. While a braze joint can provide an alternative to machining features into a component, the ensuing joint is not equivalent to utilizing the plate material in its original form. In general, if the braze joint is properly designed in terms of initial gaps between components to be brazed together, the proper braze alloy is selected, and proper braze cycle specified, the resulting joint will have similar strength to the "parent material", but it will be lacking in other features, such as having a lower ductility. Furthermore, should the braze joint be incomplete and detected by inspection, it can be repaired through a re-braze cycle, however at additional cost and time. If an incomplete braze joint is not detected and degrades over time, the joint can crack, and for a combustor end cover, failure of the joint between the insert and end cover can occur, resulting in fluids mixing within the end cover and/or operational issues with the fuel injector.

If other repairs are required to the brazed component such as weld repair and re-machining of a feature, one applying such a repair to an end cover having a braze joint must use extreme care in the regions around the braze joint to avoid contamination or weakening of the braze joint, whereas, one applying such a repair to "parent" material does not have such issues. A further concern regarding weakening of the braze joint is with respect to heat treatment cycles for stress relieving. The heat treatment cycles must be specifically designed such as to not degrade the braze joint. In general, for the reasons set forth above, it is desired, if at all possible, that for combustion components exposed to large temperature gradients and pressure loads to minimize the use of braze joints and utilize the plate material to its fullest extent possible. The present invention accomplishes this goal by providing wall 35 that is integrally formed from a portion of plate 21, thereby improving the structural integrity of end cover 20.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. An end cover for a gas turbine combustor, said end cover comprising:

a plate having a plate diameter, plate thickness, forward face, aft face, and a centerline;

a first fluid inlet extending from said aft face;

a second fluid inlet extending from said aft face;

a first manifold in fluid communication with said first fluid inlet;

a second manifold in fluid communication with said second fluid inlet; and, a plurality of first openings located along said forward face and about said centerline, said first openings in fluid communication with said first and second manifolds such that a first fluid from said first manifold is separated from a second fluid from said second manifold by a wall integrally formed from a portion of said plate.

2. The end cover of claim 1 further comprising a central opening located along said centerline and extending from said aft face to said forward face.

3. The end cover of claim 1 wherein said first fluid is air.

4. The end cover of claim 1 wherein said second fluid is gas.

5. The end cover of claim 1 wherein said plate is stainless steel.

6. The end cover of claim 1 wherein said second manifold is located radially outward of said first manifold.

7. The end cover of claim 1 wherein said first openings contain a means for fixing a fuel injector to said end cover, proximate said forward face.

8. The end cover of claim 7 wherein said means for fixing a fuel injector to said end cover preferably comprises a threaded region that corresponds to a threaded region on said fuel injector.

9. The end cover of claim 1 wherein said plurality of first openings comprises at least five openings.

10. The end cover of claim 1 further comprising a plurality of second openings located in said aft face and corresponding to each of said first openings for supplying a liquid fuel to said first openings.

11. An end cover for a dual fuel gas turbine combustor, said end cover comprising:

a plate having a plate diameter, plate thickness, forward face, aft face, and a centerline;

a first fluid inlet extending from said aft face;

a second fluid inlet extending from said aft face;

a first manifold in fluid communication with said first fluid inlet;

a second manifold in fluid communication with said second fluid inlet;

a plurality of first openings located along said forward face and about said centerline, said first openings in fluid communication with said first and second manifolds such that a first fluid from said first manifold is separated from a second fluid from said second manifold by a wall integrally formed from a portion of said plate; and, a plurality of second openings located in said aft face and corresponding to each of said first openings for supplying a liquid fuel to said first openings.

12. The end cover of claim 11 further comprising a central opening located along said centerline and extending from said aft face to said forward face.

13. The end cover of claim 11 wherein said first fluid is air.

14. The end cover of claim 11 wherein said second fluid is gas.

15. The end cover of claim 11 wherein said plate is stainless steel.

16. The end cover of claim 11 wherein said second manifold is located radially outward of said first manifold.

17. The end cover of claim 11 wherein said first openings contain a means for fixing a fuel injector to said end cover, proximate said forward face.

18. The end cover of claim 17 wherein said means for fixing a fuel injector to said end cover preferably comprises a threaded region that corresponds to a threaded region on said fuel injector.

19. The end cover of claim 11 wherein said plurality of first openings comprises at least five openings.

* * * * *